US008708434B2

(12) United States Patent
Oppel

(10) Patent No.: US 8,708,434 B2
(45) Date of Patent: Apr. 29, 2014

(54) DISHWASHER, IN PARTICULAR DOMESTIC DISHWASHER

(75) Inventor: Anton Oppel, Syrgenstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 174 days.

(21) Appl. No.: 13/225,628

(22) Filed: Sep. 6, 2011

(65) Prior Publication Data

US 2012/0074822 A1 Mar. 29, 2012

(30) Foreign Application Priority Data

Sep. 29, 2010 (DE) ..... 10 2010 041 671

(51) Int. Cl.
*A47B 77/08* (2006.01)

(52) U.S. Cl.
USPC ..... 312/228.1; 312/334.9; 211/41.8

(58) Field of Classification Search
USPC ..... 312/228.1, 228, 408, 410, 311, 334.8, 312/334.9, 334.21, 334.17, 334.18, 334.19; 211/41.8–41.9
See application file for complete search history.

(56) References Cited

U.S. PATENT DOCUMENTS

| | | | | | |
|---|---|---|---|---|---|
| 1,748,843 | A | * | 2/1930 | Kuckel | 312/408 |
| 1,837,293 | A | * | 12/1931 | Sanford | 312/408 |
| 1,861,123 | A | * | 5/1932 | Kuckel | 312/293.2 |
| 2,428,216 | A | * | 9/1947 | Harbison | 312/408 |
| 2,648,588 | A | * | 8/1953 | Ruspino | 312/308 |
| 2,719,772 | A | * | 10/1955 | Petkwitz | 312/408 |
| 2,724,630 | A | * | 11/1955 | Saunders | 312/408 |
| 3,099,501 | A | * | 7/1963 | Hillson et al. | 384/19 |
| 3,469,892 | A | * | 9/1969 | Langstroth | 384/18 |
| 3,486,804 | A | * | 12/1969 | Kauffman et al. | 312/228.1 |
| 3,744,646 | A | * | 7/1973 | Duncan et al. | 211/162 |
| 3,804,483 | A | * | 4/1974 | Afful et al. | 312/228.1 |
| 3,982,802 | A | * | 9/1976 | Bailey | 312/228.1 |
| 4,138,175 | A | * | 2/1979 | Tattershall | 312/408 |
| 4,979,262 | A | * | 12/1990 | Lautenschlager | 16/97 |
| 5,090,820 | A | * | 2/1992 | Lautenschlager | 384/19 |
| 5,580,174 | A | * | 12/1996 | Houck | 384/19 |
| 5,733,026 | A | * | 3/1998 | Munachen | 312/334.12 |
| 6,729,705 | B2 | * | 5/2004 | Wolanin et al. | 312/408 |
| 8,056,996 | B2 | * | 11/2011 | Koloff et al. | 312/404 |
| 2004/0256333 | A1 | | 12/2004 | Buhlmeyer et al. | |
| 2004/0263038 | A1 | * | 12/2004 | Ribolzi et al. | 312/408 |
| 2005/0174022 | A1 | * | 8/2005 | Kuttalek | 312/410 |
| 2009/0079312 | A1 | * | 3/2009 | Laible | 312/334.27 |

FOREIGN PATENT DOCUMENTS

| | | | | | |
|---|---|---|---|---|---|
| DE | 3102836 | A1 | * | 8/1982 | A47L 15/50 |
| DE | 10218064 | A1 | * | 12/2003 | A47L 15/42 |
| DE | 102009002671 | A1 | * | 10/2010 | A47L 15/50 |
| EP | 1323548 | A2 | * | 7/2003 | B60B 17/00 |
| WO | 2008077713 | A1 | | 7/2008 | |

* cited by examiner

*Primary Examiner* — Hanh V Tran
(74) *Attorney, Agent, or Firm* — James E. Howard; Andre Pallapies

(57) ABSTRACT

A dishwasher, in particular domestic dishwasher, includes a washing tub which has at least one bearing race of a basket guide on each of its side walls respectively. The bearing race is rotatably mounted on a bearing point, which has a securing element to secure the bearing race in an axial direction. The securing element of the bearing point is constructed in the form of a retainer plate, which, as a separate component, is connected with the side wall of the washing tub by a material bond.

24 Claims, 3 Drawing Sheets

DISHWASHER, IN PARTICULAR DOMESTIC DISHWASHER

BACKGROUND OF THE INVENTION

The invention relates to a dishwasher, in particular a domestic dishwasher, as claimed in the preamble of claim 1.

The upper rack of a dishwasher is usually supported on lateral rack guides, with the aid of which the rack can be removed from the washing tub in order to load and unload the items to be washed. Each of the lateral rack guides can comprise a rack guide rail, on the upper and lower sides of which rolling rollers can roll, which are rotatably mounted on the rack side wall. The rack guide rail in turn comprises a C-shaped hollow profile, which encompasses the bearing races which are rotatably mounted on the washing tub side wall. As a result, the rack guide rail can itself also be removed from the washing tub in a telescopic fashion.

A dishwasher is known from DE 101 54 557 A1, in which at least one bearing race of such a rack guide is provided in each instance on each of the washing tub side walls. The bearing race is rotatably mounted on or at a bearing point. The bearing point comprises a radially extended retaining element, which secures the bearing race to the bearing point in the axial direction.

In DE 101 54 557 A1, the radially extended retaining element is an annular shoulder, which is embodied on the side of a central element which faces away from the washing tub wall and prevents the bearing race from detaching from the central element. The central element forms the bearing point on which the bearing race is mounted. The central element is provided with a threaded shaft with a minimal diameter on the side facing the washing tub wall, said threaded shaft being guided through an assembly opening in the washing tub wall and being joined to an outer screw element in a complex fashion in terms of assembly. Aside from the comparatively large assembly costs, there is the problem here that the opening has to be sealed in a water-tight fashion with additional measures.

DE 10 2006 061 101 A1 likewise discloses a rotatable mounting of a bearing race for a rack guide, whereby the bearing race is rotatably mounted on a bearing journal. The bearing journal is guided outwards through an assembly opening. The assembly opening is arranged in an apex surface of an impression of the washing tub wall which protrudes into the dishwasher interior.

BRIEF SUMMARY OF THE INVENTION

It is an object of the invention to provide a dishwasher in which the bearing race can be easily held on the washing tub side wall in terms of assembly and a cost-effective low friction extraction can simultaneously be realised.

The object is achieved by the features of claim 1. Preferred developments of the invention are disclosed in the subclaims.

According to the characterising portion of claim 1, the retaining element of the bearing point is a retainer plate, which, as a separate component, has a direct adhesive bond connection with the side wall of the washing tub. Contrary to the aforecited prior art, the inventive retaining element is therefore not fastened in a complicated fashion to a central element screwed to the washing tub side wall but is instead directly welded or adhered to the washing tub wall or connected in another fashion using an adhesive bond. An additional assembly opening with a sealing effort resulting therefrom can therefore be prevented. An opening in the respective washing tub side wall can therefore be prevented.

In order to ensure a smooth pivot bearing, the bearing point can comprise in particular a cylindrical bearing segment, on the exterior of which the bearing race is rotatably mounted. In accordance with an advantageous embodiment variant, the bearing race can either be in direct sliding contact with the cylindrical bearing segment or in accordance with a further advantageous embodiment variant can rest on the cylindrical bearing segment by interconnecting a roller bearing. In a particularly simple mounting of a further advantageous embodiment, the bearing race expediently rests with its radially interior hub section on the cylindrical bearing segment. This therefore forms a bearing surface, with which the radial exterior hub section of the bearing race is in sliding contact therewith.

In terms of reducing components, it may be advantageous if the cylindrical bearing segment of the bearing point is preferably integrated in a materially integral manner and/or in one piece directly in the retainer plate. In this case, the bearing point can only be completed by welding/adhering the retainer plate to the washing tub wall or by another adhesive bond connection of the retainer plate with the washing tub wall.

The retainer plate can preferably be a sheet metal part. The cylindrical bearing segment can herewith be moulded in a hollow-cylindrical fashion into the sheet metal part using the deep drawing process. In this case, the retainer plate can be a rotationally-symmetrical hollow part, the front side of which, which faces the washing tub side, is closed. The front side facing away from the washing tub side wall can merge in particular into a radially extended annular shoulder, which prevents the bearing race from detaching from the bearing point.

As mentioned above, with regards to reducing components, it may be advantageous if the cylindrical bearing segment is integrated in particular directly in the retainer plate. Alternatively, the cylindrical bearing segment can also be integrated in a materially integral manner and/or in one piece directly in the washing tub side wall. In this case, the bearing point can be an impression moulded in the washing tub side wall. This can preferably be designed in a rotationally-symmetrical fashion and protrude into the dishwasher interior. Furthermore, the impression forming the bearing segment can comprise a closed apex surface which faces the dishwasher interior. This apex surface can preferably be brought into large-scale contact with the retainer plate in order to produce the adhesive bond connection. The cylindrical bearing segment can be impressed during an impression process which is already carried out in the manufacturing process. During the impression process, stiffening beads or other function segments can be impressed into the washing container side wall for instance.

For component reduction purposes, it may be advantageous for the cylindrical bearing segment of the bearing point to be a direct component part of the aforecited impression. The cylindrical bearing segment may be provided in the impression such that the aforecited apex surface of the impression directly connects inwards to the front in the axial direction. This produces an overall large impression depth, which may possibly result in cracks particularly in the case of minimal wall thicknesses of the washing tub side wall. To prevent cracks of this type, it may be advantageous not to integrate the cylindrical bearing segment into the washing container side wall but instead into the inventive retainer plate.

To provide adequate operating space for the rack guide arranged laterally on the washing tub side wall, the mentioned impression can be expediently embodied with a predetermined impression depth. To ensure that the impression is adequately inherently stable also in the case of larger impression depths, this may be embodied in particular at least partially in the shape of a truncated cone. In the outer lateral area of the truncated cone-shaped impression, the cylindrical bearing segment can connect inwardly to an annular shoulder in the axial direction, on which bearing segment the bearing race is mounted.

For a simple and smooth pivot bearing, the bearing point can be designed in particular as an annular groove, in which the bearing race is rotatably guided with active game both in the axial direction and also in the radial direction. It is preferable in manufacturing terms for the annular groove of the bearing point to be structured using simple means. Against this background, the base of the groove can be formed by the exterior of the cylindrical bearing segment. The outer groove side wall in the axial direction can on the other hand be designed by the already aforementioned annular shoulder of the impression of the washing tub side wall. Alternatively, the outer groove side wall can be formed directly by the apex surface of the impression. The opposite inner groove side wall can on the other hand be formed by the inventive retainer plate.

The inventive embodiment of the bearing point enables assembly openings in the washing tub side wall to be avoided and enables the washing tub side wall to be embodied in a holohedrally closed fashion. The bearing race can preferably be embodied from plastic material. In particular in the case of the aforecited plain friction bearing, a frictional pair therefore results consisting of plastic and the metal of the cylindrical bearing segment, as a result of which favourable running characteristics with minimal dynamic friction can be achieved.

The aforecited and/or advantageous embodiments and developments of the invention which are reproduced in the subclaims can be used individually or also in any combination with one another except for in cases of clear dependencies or inconsistent alternatives for instance.

BRIEF DESCRIPTION OF THE DRAWINGS

The invention and its advantageous embodiments and developments as well as its advantages are described in more detail below with the aid of drawings, in which each show in a schematic diagram.

DETAILED DESCRIPTION OF EXEMPLARY EMBODIMENTS OF THE PRESENT INVENTION

Figure 1:
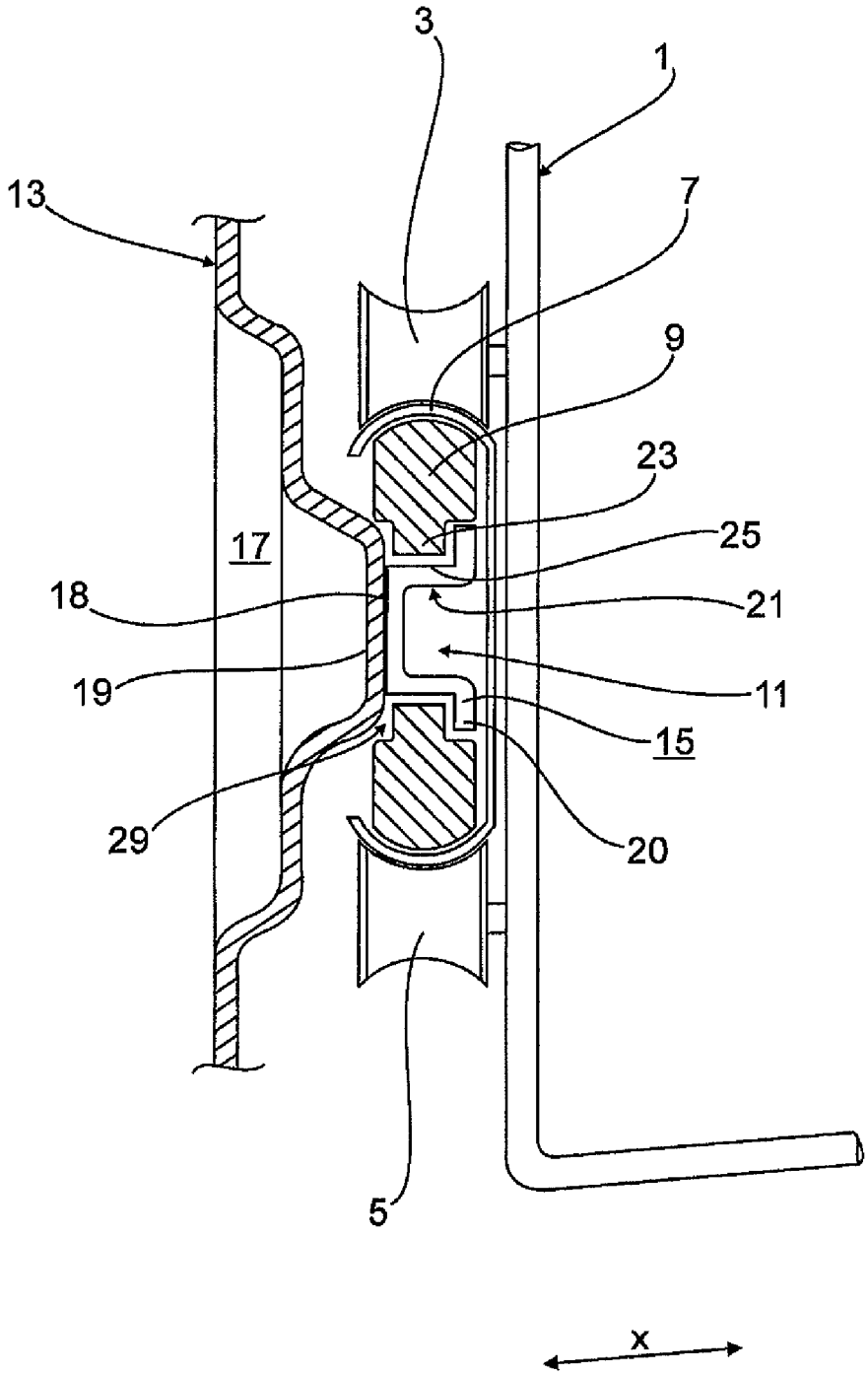
FIG. 1 a partial side view of an upper rack of a dishwasher, which is supported against the side wall of a washing tub by way of a rack guide according to a first exemplary embodiment, and FIGS. 2 and 3 views according to FIG. 1, which show a second and third exemplary embodiment of the invention.
Figure 2:
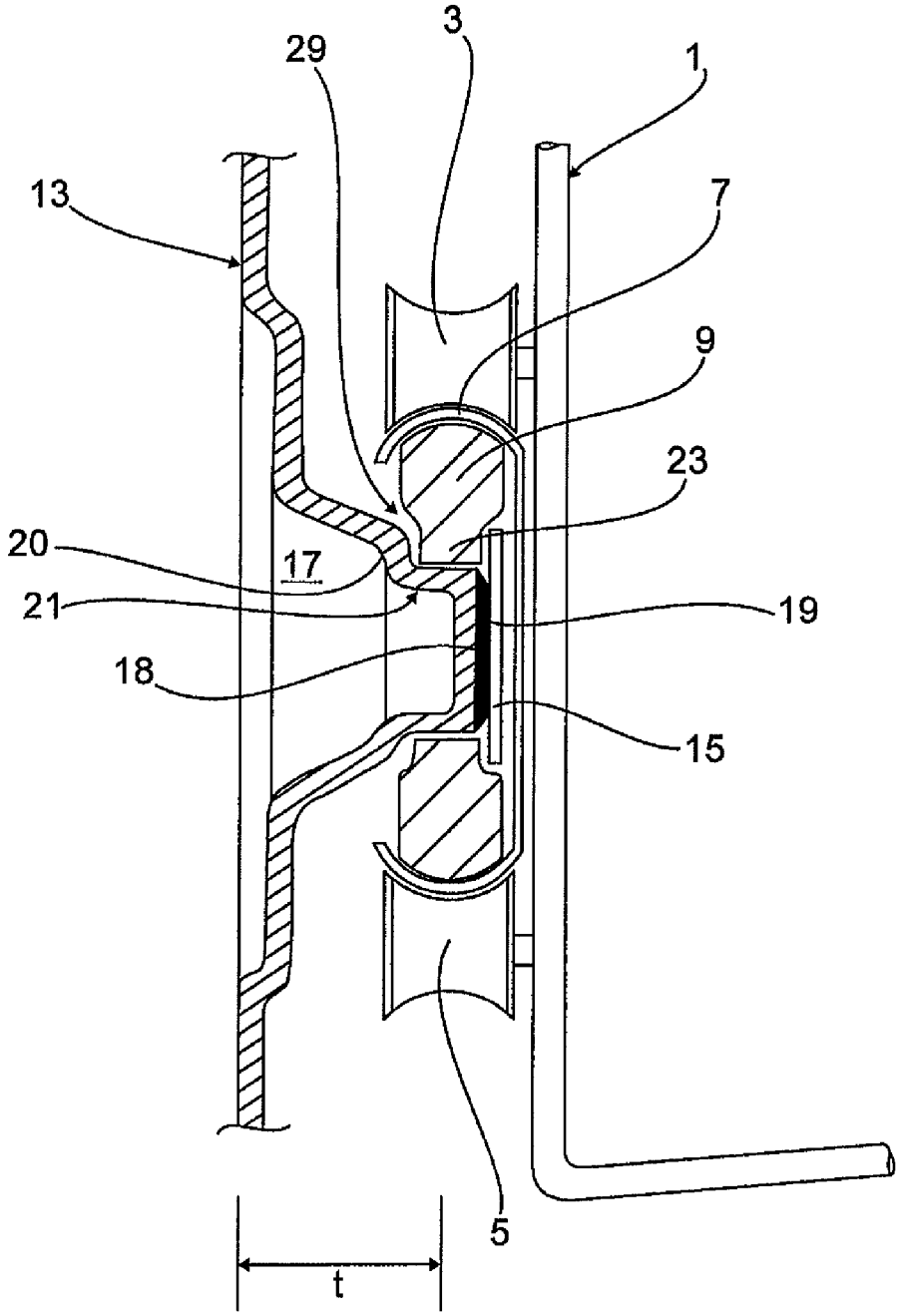
Figure 3:
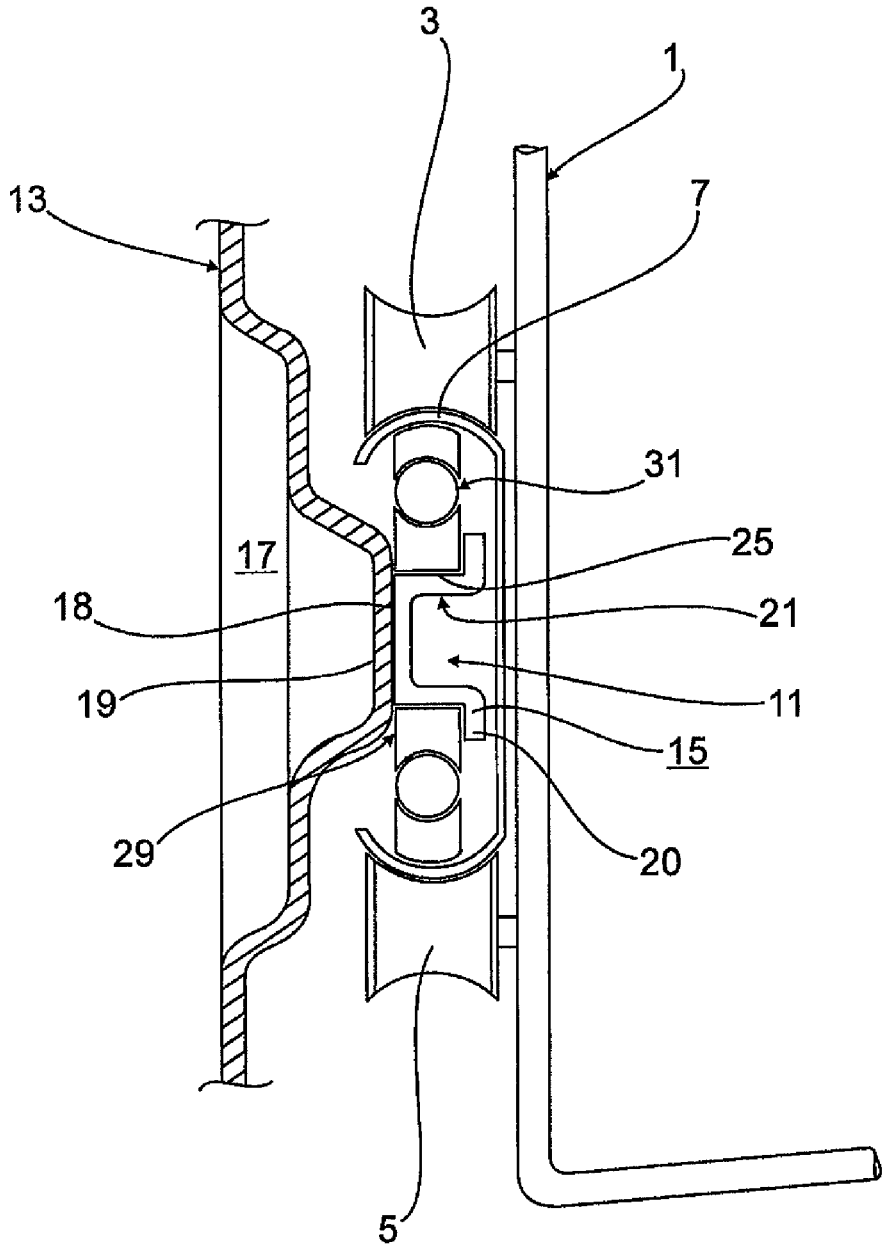

Elements with the same function and mode of operation are provided in FIGS. 1 to 3 with the same reference characters in each instance.

FIG. 1 shows a rack 1 of a domestic dishwasher, which is mounted on a rack guide of a dishwasher (not shown) by means of upper and lower rack rollers 3, 5. The rack guide consists of a rack guide rail 7, which is embodied in the exemplary embodiment here as a C-shaped hollow profile. The rack rollers 3, 5 are rotatably mounted on the upper and lower side of the rack guide rail 7. In addition, the rack guide rail 7 encompasses a bearing race 9 consisting of a plastic material, which is rotatably mounted on a bearing point 11 on a washing tub side wall 13. As a result, the rack 1 for loading items to be washed can be extracted in the construction depth direction of the device and then reinserted.

The bearing point 11 shown in FIG. 1 comprises a retainer plate 15, which is directly connected to the washing tub side wall 13. An apex surface 18 is provided by a rotationally-symmetrical impression and/or moulding 17 of the washing tub side wall 13 which protrudes into the dishwasher interior. It essentially proceeds in parallel to the bearing plane of the washing tub side wall 13, which extends in the depth and height direction of the washing tub of the dishwasher. The apex surface 18 of the washing tub side wall 13 has a welded connection 19 with the retainer plate 15. Contrary to a screw connection, additional assembly openings can herewith be avoided and the washing tub side wall 13 can be embodied holohedrally closed in the region of the bearing point 11. Sealing measures are therefore avoided. An opening in the washing tub side wall can therefore be avoided.

According to FIG. 1, the retainer plate 15 is a separate sheet metal part, which is manufactured as a rotationally-symmetrical hollow element in a deep drawing process. The rotationally-symmetrical hollow element is closed on the side facing the washing tub side wall 13. The hollow element also radially extends on its front side facing away from the washing tub side wall 13 and forms an annular shoulder 20. The annular shoulder 20 is used as a retaining element, whereby it prevents the bearing race 9 from detaching from the bearing point 11 in the axial direction.

As shown in FIG. 1, the bearing race 9 is rotatably mounted on the retainer plate 15. The bearing is enabled by an exterior of a cylindrical bearing segment 21 of the retainer plate 15. The cylindrical bearing segment 21 is integrated in the retainer plate 15. The bearing race 9 has a radial hub section 23, which is in sliding contact with a bearing surface 25 of the cylindrical bearing segment 21. The bearing surface 25 is formed by the exterior of the cylindrical bearing segment 21.

In FIG. 1, the bearing point 11 of the bearing race 9 forms an annular groove 29. The annular groove 29 is embodied such that the bearing surface 25 of the cylindrical bearing segment 21 forms the base of the groove. The groove side walls are formed axially internally by the apex surface 18 and axially externally by the opposite annular shoulder 20 of the retaining flap 15.

FIG. 2 describes a second embodiment of the invention. Contrary to FIG. 1, the cylindrical bearing segment 21 is not integrated in the retainer plate 15, but instead in a materially integral fashion and in one piece in the washing tub side wall 13. This embodiment is achieved by the impression 17 of the washing tub side wall 13. The impression 17 comprises an annular shoulder 20, to which the cylindrical bearing segment 21 connects in the axial direction. The impression depth tin this embodiment is greater than that in the preceding embodiment.

According to FIG. 2, the apex surface 18 connects directly inwards with its front side to the cylindrical bearing segment 21 in the axial direction. The apex surface 18 is connected to the retainer plate 15 by means of a welded connection 19. In this embodiment, the retainer plate 15 is a discoid component. To ensure that the bearing race 9 is not able to detach in the axial direction, the diameter of the retainer plate 15 is greater than the diameter of the apex surface 18.

Similarly to in FIG. 1, the bearing point of the bearing race 9 has an annular groove 29. Contrary to FIG. 1, it is however not the retainer plate 15, but instead the impression 17 which forms the bearing surface 25. The annular groove 29 is embodied in FIG. 2 such that the bearing surface 25 of the cylindrical bearing segment 21 forms the base of the groove.

The exterior side wall of the groove is formed by the annular shoulder 20 of the impression 17 of the washing tub side wall 13 and the opposite inner side wall of the groove is formed by the retainer plate 15.

FIG. 3 shows a third embodiment of the invention, in which the cylindrical bearing segment 21, identical to that of the exemplary embodiment in FIG. 1, is integrated in the retainer plate 15. The further design is basically identical to the design shown in FIG. 1. Contrary to the preceding embodiments, the bearing race in FIG. 3 is not a slide bearing but instead a roller bearing 31. The inner ring of the roller bearing 31 herewith rests fixedly on the exterior of the cylindrical bearing segment 21 using press-fit. In this embodiment the outer ring of the roller bearing 31 is similarly also that of the bearing race.

What is claimed is:

1. A dishwasher, comprising:

a washing tub to contain items to be washed, the washing tub including a side wall with a portion having a continuous interior surface that at least partially defines an interior of the dishwasher;

a rack guide having at least one bearing race; and a bearing point rotatably mounting the bearing race on the side wall such that the bearing race rotates about the bearing point, the bearing point including a retaining element to secure the bearing race in an axial direction, said retaining element being constructed as a separate retainer plate which is directly connected with the side wall of the washing tub by a first material bond extending only over the continuous interior surface of the sidewall without utilizing an aperture formed in the sidewall such that the sidewall of the washing tub is completely closed in the region of the bearing point.

2. The dishwasher of claim 1, constructed in the form of a domestic dishwasher.

3. The dishwasher of claim 1, wherein the retaining element is constructed to extend in a radial direction.

4. The dishwasher of claim 1, wherein the retaining element is welded to the side wall of the washing tub.

5. The dishwasher of claim 1, wherein the bearing point comprises a cylindrical bearing segment, said bearing race being rotatably mounted on an exterior of the cylindrical bearing segment.

6. The dishwasher of claim 5, wherein the exterior of the cylindrical bearing segment forms a bearing surface, which is in sliding contact with a hub section of the bearing race.

7. The dishwasher of claim 5, further comprising a roller bearing, wherein the bearing race rests on the cylindrical bearing segment of the bearing point via the roller bearing.

8. The dishwasher of claim 7, wherein the roller bearing is a ball bearing.

9. The dishwasher of claim 1, wherein the retainer plate is a sheet metal part having a front side which faces the side wall of the washing tub and is closed.

10. The dishwasher of claim 1, wherein the retainer plate is a sheet metal part having a front side which faces away from the side wall of the washing tub and comprises a radially extended annular shoulder for axially securing the bearing race.

11. The dishwasher of claim 9, wherein the sheet metal part is a hollow cylindrical deep-drawing part.

12. The dishwasher of claim 10, wherein the sheet metal part is a hollow cylindrical deep-drawing part.

13. The dishwasher of claim 5, wherein the cylindrical bearing segment is embodied in at least one of two ways, a first way in which the cylindrical bearing segment is embodied in a materially integral fashion with the retainer plate, a second way in which the cylindrical bearing segment is embodied in one piece with the retainer plate.

14. The dishwasher of claim 5 wherein the cylindrical bearing segment is integrated in a materially integral fashion and in one piece in the side wall of the washing tub.

15. The dishwasher of claim 1, wherein the bearing point comprises an impression which protrudes into a dishwasher interior and is moulded in the side wall of the washing tub, said impression comprising an apex surface which is closed and faces the dishwasher interior and which is connected to the retainer plate by the first material bond.

16. The dishwasher of claim 15, wherein the impression is rotationally-symmetrical.

17. The dishwasher of claim 15, wherein the bearing point comprises a cylindrical bearing segment which is a component part of the impression.

18. The dishwasher of claim 17, wherein the apex surface connects directly inwards on a front side to the cylindrical bearing segment in the axial direction.

19. The dishwasher of claim 17, wherein the impression is embodied at least partially in the shape of a truncated cone.

20. The dishwasher of claim 17, wherein the impression includes at least one annular shoulder to which the cylindrical bearing segment connects inwardly in the axial direction.

21. The dishwasher of claim 1, wherein the bearing point comprises an annular groove in which a hub section of the bearing race is rotatably guided.

22. The dishwasher of claim 21, wherein the bearing point comprises an impression which protrudes into a dishwasher interior and is moulded in the side wall of the washing tub and which comprises an apex surface, said annular groove having a base which forms an exterior of a cylindrical bearing segment of the bearing point, said annular groove including an exterior groove side wall which is formed by the an annular shoulder of the impression of the side wall of the washing tub and/or by an exterior edge of the apex surface of the impression.

23. The dishwasher of claim 21, wherein the annular groove has an inner groove side wall which is formed by the retainer plate.

24. The dishwasher of claim 1, wherein the bearing point comprises a cylindrical bearing segment in sliding contact with the bearing race, said bearing race being manufactured from plastic material and said cylindrical bearing segment being manufactured from metal.

* * * * *